US008260166B2

(12) United States Patent
Matsuda et al.

(10) Patent No.: US 8,260,166 B2
(45) Date of Patent: Sep. 4, 2012

(54) IMAGE FORMING APPARATUS AND ELECTRIC APPLIANCE INCLUDING A THERMOELECTRIC ELEMENT

(75) Inventors: Yuji Matsuda, Tokyo (JP); Hiroyuki Takahashi, Kanagawa (JP); Hiroki Ohkubo, Kanagawa (JP); Yusuke Ozaki, Tokyo (JP); Eiji Nemoto, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 986 days.

(21) Appl. No.: 12/126,553

(22) Filed: May 23, 2008

(65) Prior Publication Data

US 2008/0292351 A1 Nov. 27, 2008

(30) Foreign Application Priority Data

May 24, 2007 (JP) ..... 2007-137891
Apr. 23, 2008 (JP) ..... 2008-112685

(51) Int. Cl.
*G03G 15/00* (2006.01)

(52) U.S. Cl. ..... 399/88

(58) Field of Classification Search ..... 399/81, 399/88; 136/205, 291, 293, 411
See application file for complete search history.

(56) References Cited

U.S. PATENT DOCUMENTS

| | | | | |
|---|---|---|---|---|
| 5,598,279 | A | 1/1997 | Ishii et al. | |
| 6,281,594 | B1 * | 8/2001 | Sarich | 290/1 R |
| 6,799,282 | B2 * | 9/2004 | Maeda et al. | 713/500 |
| 7,532,937 | B2 * | 5/2009 | Horio et al. | 607/57 |
| 7,626,114 | B2 * | 12/2009 | Stark | 136/205 |
| 7,653,323 | B2 * | 1/2010 | Sone et al. | 399/69 |
| 2005/0084276 | A1 * | 4/2005 | Hirst et al. | 399/81 |
| 2006/0285867 | A1 * | 12/2006 | Takahashi et al. | 399/70 |
| 2007/0098432 | A1 * | 5/2007 | Mashiki | 399/88 |
| 2008/0259071 | A1 * | 10/2008 | Nemoto et al. | 345/212 |

FOREIGN PATENT DOCUMENTS

| | | | |
|---|---|---|---|
| JP | 10341043 | A * | 12/1998 |
| JP | 2001-282399 | | 10/2001 |
| JP | 2004227157 | A * | 8/2004 |
| JP | 3646958 | | 2/2005 |
| JP | 2005290901 | A * | 10/2005 |
| JP | 2005340427 | A * | 12/2005 |

* cited by examiner

*Primary Examiner* — Robert Beatty
(74) *Attorney, Agent, or Firm* — Oblon, Spivak, McClelland, Maier & Neustadt, L.L.P.

(57) ABSTRACT

A thermoelectric conversion element converts thermal energy of a user into electric power. A holding unit holds the electric power converted by the thermoelectric conversion element, and outputs the electric power. A switching unit switches between a first mode in which electric power is supplied to all units of an image forming apparatus and a second mode in which electric power is supplied to a part of units of the image forming apparatus. When the image forming apparatus is in the second mode, the switching unit switches from the second mode to the first mode upon receiving the electric power output from the holding unit.

16 Claims, 8 Drawing Sheets

IMAGE FORMING APPARATUS AND ELECTRIC APPLIANCE INCLUDING A THERMOELECTRIC ELEMENT

CROSS-REFERENCE TO RELATED APPLICATIONS

The present application claims priority to and incorporates by reference the entire contents of Japanese priority documents 2007-137891 filed in Japan on May 24, 2007 and 2008-112685 filed in Japan on Apr. 23, 2008.

BACKGROUND OF THE INVENTION

1. Field of the Invention

The present invention relates to an image forming apparatus and an electric appliance.

2. Description of the Related Art

A typical power control used in image forming apparatuses has three modes including a power-OFF mode, a stand-by mode, and a sleep mode.

In the power-OFF mode, a main power-supply switch is OFF and no power is supplied to the image forming apparatus, i.e., power consumption is zero.

In the stand-by mode, the main power-supply switch is ON and alternating current (AC) power is supplied to the image forming apparatus. Internally-used direct current (DC) power of, for example, 5 volts and 24 volts is generated from the AC power. The image forming apparatus is ready to perform an image-forming operation by driving by driving mechanism loads through a motor or a clutch with the generated DC power.

In the sleep mode, power is supplied to only a specific device that is a part of the image forming apparatus while the power supply to the other devices is cut off, which leads to lower power consumption. The image forming apparatus is switched to the sleep mode, for example, when a long period has passed since the last operation, or when a user makes a command to shift to the sleep mode via an operation key.

The specific device is connected to an output side of a return sensor and an external-device interface. When the specific device detects a state change about the return sensor or the external-device interface, the specific device starts a shift operation from the sleep mode to the stand-by mode. The specific device starts the shift operation, for example, when a user tries to perform a copy operation or an original reading operation, when a print command is received from an external device via a local area network (LAN) or a universal serial bus (USB), or when facsimile data is received. After the shift operation is completed, the image forming apparatus performs a print operation.

A control system of a conventional image forming apparatus is described below with reference to FIG. 8.

The conventional image forming apparatus includes an AC plug 1001, an AC switch 1002, a power-supply unit 1004, a mechanism control unit 1005, a group of mechanism loads 1006, a system control unit 1007, an image reading unit 1008, an image writing unit 1009, and a group of return sensors 1011. Reference numeral 1010 denotes external device.

When the AC switch 1002 is ON in a situation that the AC plug 1001 is connected to the AC outlet, the AC power is supplied to the power-supply unit 1004. The power-supply unit 1004 generates DC power including 24-V power and 5-V power, and supplies the DC power to the mechanism control unit 1005 and the system control unit 1007.

The mechanism control unit 1005 includes a central processing unit (CPU, not shown) and input/output control driver (I/O control driver, not shown). Upon receiving the DC power, the CPU activates and then performs driving of the mechanism loads 1006 in accordance with a predetermined image-forming sequence.

The image reading unit 1008 includes a lamp (not shown) that illuminates an original and a charge-coupled device (CCD, not shown). The image reading unit 1008 reads image data of the original by emitting a light to the original placed on an exposure glass and then receiving the light reflected from the original.

Upon receiving, as synchronizing with operation of the mechanism control unit 1005, the image data from the image reading unit 1008 as copy data, the system control unit 1007 processes the received image data and sends the processed image data to the image writing unit 1009.

The system control unit 1007 is connected to the external device 1010 via an interface such as a LAN or a USB. Upon receiving image data from the external device 1010 as print data, the system control unit 1007 enlarges/reduces the received image data or adjusts layout of the received image data, and sends the processed image data to the image writing unit 1009.

Upon receiving the image data from the system control unit 1007, the image writing unit 1009 switches ON/OFF of a laser diode based on the received image data, and emits a laser light from the laser diode to the photosensitive element, thereby forming an electrostatic latent image on a photosensitive element. After that, the electrostatic latent image on the photosensitive element is developed with toners, the developed toner image is transferred onto a recording medium, and the recording medium with the image is obtained.

In the following description, an explanation about a process of transferring the image on the photosensitive element onto the recording medium is omitted because the process is not a main subject of the present invention.

The power-supply unit 1004 includes two switches through which the DC voltage is output; one is for 24 volts and the other is for 5 volts. The switches turn ON/OFF based on a PON_ENG signal that is output by the system control unit 1007. The mechanism control unit 1005 receives the 5-V power and the 24-V power passed through the switches. The system control unit 1007 receives the DC power of 5 VE without passing through the switches.

The system control unit 1007 is connected to the return sensors 1011 including, for example, a power switch on an operation panel, a placed-original detecting sensor, or a platen-open/close detecting sensor. The system control unit 1007 monitors whether the user tries to operate the image forming apparatus during the sleep mode by constantly monitoring the return sensors 1011.

Moreover, the system control unit 1007 constantly monitors whether a print command has been received from the external device 1010 via the LAN or the USB or whether facsimile data has been received. When the system control unit 1007 detects a return factor from the return sensor 1011 or the external device 1010, the system control unit 1007 asserts the PON_ENG signal. In response to the asserted PON_ENG signal, the switches turn ON and the 5-V DC power and the 24-V DC power are supplied to the mechanism control unit 1005. Thus, the main system of the image forming apparatus activates.

When the system control unit 1007 detects that a long period has been passed since the last operation or a command to shift to the sleep mode has been received from a user using the operation key, the system control unit 1007 negates the PON_ENG signal. In response to the negated PON_ENG signal, the switches of the power-supply unit 1004 turn OFF and the power-supply unit 1004 stops supplying the 5-V power and the 24-V power to the mechanism control unit 1005. Thus, the image forming apparatus is shifted to the sleep mode.

In this manner, the image forming apparatus is automatically shifted to the sleep mode when a predetermined period has passed since the last operation, while automatically shifted to the stand-by mode when the signal from the return sensor monitored by the CPU is ON. This makes it possible to reduce the power consumption.

FIG. 9 is a timing chart for explaining operation performed by the conventional image forming apparatus.

When the AC switch 1002 turns ON, the AC power is supplied to the power-supply unit 1004, and the power-supply unit 1004 generates the 5-VE power from the AC power. When the system control unit 1007 receives the 5-VE power, the CPU of the system control unit 1007 activates and asserts the PON_ENG signal. The switches of the power-supply unit 1004 turn ON in response to the asserted PON_ENG signal, so that the 5-V power and the 24-V power are supplied to the mechanism control unit 1005. Thus, the image forming apparatus activates, i.e., is ready to operate.

Moreover, when it is determined with an internal timer of the system control unit 1007 that a long period has passed since the last operation, the system control unit 1007 negates the PON_ENG signal. In response to the negated PON_ENG signal, the power-supply unit 1004 stops supplying the 5-V power and the 24-V power. Thus, the image forming apparatus shifts to the sleep mode. During the sleep mode, the CPU of the system control unit 1007 constantly monitors the return sensor. When detecting that a user tries to operate the image forming apparatus, the system control unit 1007 asserts the PON_ENG signal again to activate the image forming apparatus.

Japanese Patent No. 3646958, which has been issued to the applicants of the present application, discloses an image forming apparatus in which ON/OFF of a power supply is controlled taking a state of an application function into consideration. More particularly, a power-supply control signal indicative whether the application function is running a job is sent to a power-supply control unit. The power-supply control unit controls ON/OFF of the power supply based on the power-control signal.

However, the conventional image forming apparatus described above needs certain power during the sleep mode, although less than that during the stand-by mode. In other words, there is room for reducing the power consumption.

Moreover, a main object of the conventional image forming apparatus disclosed in Japanese Patent No. 3646958 is not to reduce the power consumption during the image forming apparatus being in non-operation but to prevent data corruption due to a power breakdown that may happen during an application function being activated.

SUMMARY OF THE INVENTION

It is an object of the present invention to at least partially solve the problems in the conventional technology.

According to an aspect of the present invention, there is provided an image forming apparatus including a thermoelectric conversion element that converts thermal energy of a user into electric power; a holding unit that holds the electric power converted by the thermoelectric conversion element, and outputs the electric power; and a switching unit that switches between a first mode in which electric power is supplied to all units of the image forming apparatus and a second mode in which electric power is supplied to a part of units of the image forming apparatus. When the image forming apparatus is in the second mode, the switching unit switches from the second mode to the first mode upon receiving the electric power output from the holding unit.

Furthermore, according to another aspect of the present invention, there is provided an electric appliance including a thermoelectric conversion element that converts thermal energy of a user into electric power; a holding unit that holds the electric power converted by the thermoelectric conversion element, and outputs the electric power; and a switching unit that switches between a first mode in which electric power is supplied to all units of the electric appliance and a second mode in which electric power is supplied to a part of units of the electric appliance. When the electric appliance is in the second mode, the switching unit switches from the second mode to the first mode upon receiving the electric power output from the holding unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
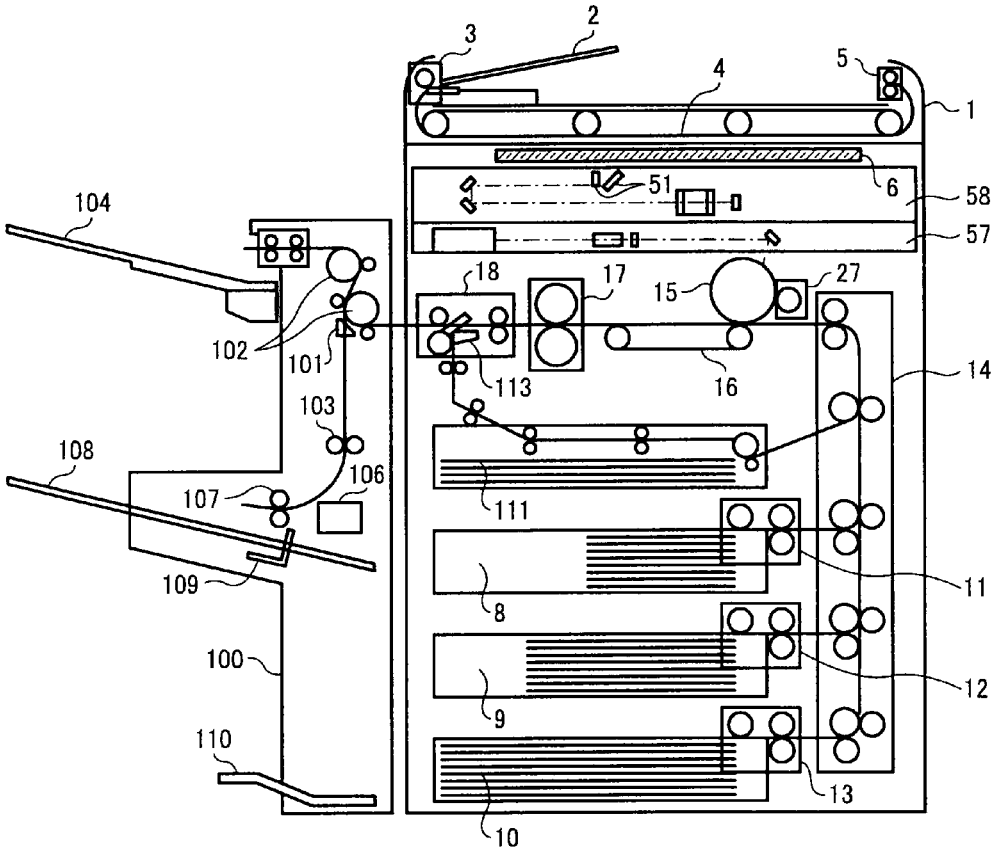
FIG. 1 is a schematic view of an image forming apparatus according to a first embodiment of the present invention.

As shown in FIG. 1, an image forming apparatus according to a first embodiment of the present invention includes an automatic document feeder (ADF) 1, an image reading unit 58, an image writing unit 57, a finisher 100 as a post-processing device.

Figure 3:
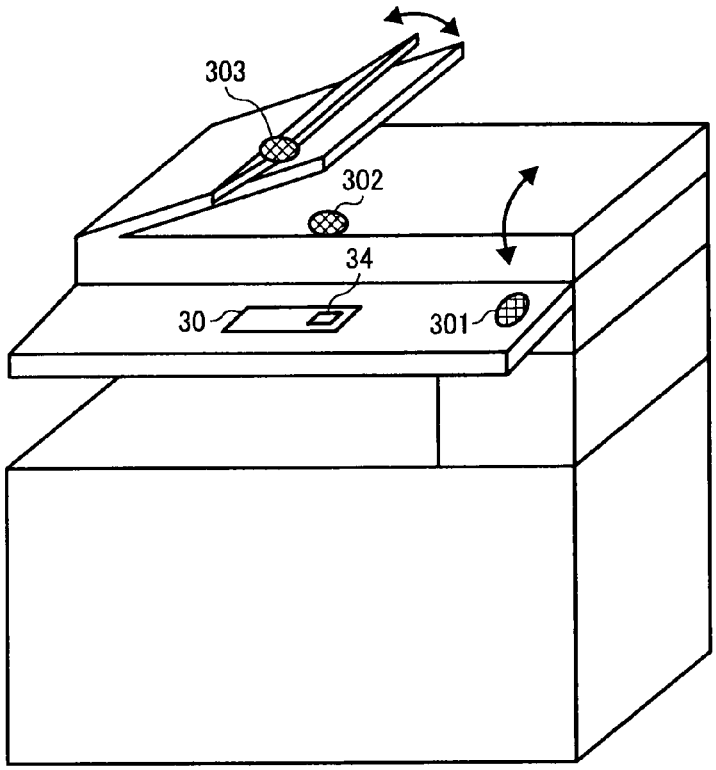
FIG. 3 is a perspective view of the image forming apparatus for explaining positions of thermoelectric elements shown in FIG. 2.

When a start key 34 on an operation unit 30 shown in FIG. 3 is pressed in a situation where a set of originals is placed on a document tray 2 with its surface to be read is upside, the originals are fed, sequentially from its bottom, by a feed roller 3 and a feed belt 4 to a predetermined position on an exposure glass 6.

After the image reading unit 58 reads image data from the original on the exposure glass 6, the original is discharged by the feed belt 4 and a discharge roller 5.

If it is determined with a document sensor 7 that there is a remaining original on the document tray 2, the remaining original on the document tray 2 is fed onto the exposure glass 6 in the same manner as the proceeding original is fed. The feed roller 3, the feed belt 4, and the discharge roller 5 are driven by a convey roller (not shown).

A recording sheet stacked on any one of a first tray 8, a second tray 9, and a third tray 10 is fed by a corresponding one of a first feed device 11, a second feed device 12, and a third feed device 13, and then conveyed to a position that makes a contact with a photosensitive element 15 by a vertical convey unit 14.

The image data obtained by the image reading unit 58 is written on the photosensitive element 15 as an electrostatic latent image with a laser emitted from the image writing unit 57. When a portion of the photosensitive element 15 with the electrostatic latent image passes through a developing unit 27, the electrostatic latent image is developed into a toner image.

The toner image on the photosensitive element 15 is transferred onto the recording sheet that is conveyed by a convey belt 16 moving at a speed equal to a rotation speed of the photosensitive element. After that, the toner image on the recording sheet is fixed by a fixing unit 17. The recording sheet with the fixed toner image is discharged by a discharge unit 18 to the finisher 100.

The finisher 100 includes a switching board 101. When the finisher 100 receives the recording sheet from the discharge unit 18 in the main body, the convey direction of the recording sheet is selectively switched by switching of the switching board 101.

More particularly, if the switching board 101 points upward, the recording sheet is discharged to a normal receiving tray 104 via rollers 102. On the other hand, if the switching board 101 points downward, the recording sheet is discharged to a staple tray 108 via convey rollers 103 and 107.

When the recording sheet is discharged on the staple tray 108, an end of the recording sheet is aligned by a jogger 109. When the last one of a set of recording sheets is discharged onto the staple tray 108, a stapler 106 staples the set of recording sheets. The stapled set of recording sheets then falls on a post-staple receiving tray 110.

On the other hand, the normal receiving tray 104 is movable forward and backward. The normal receiving tray 104 moves forward or backward before receiving a first copy of next original or a first page of a next set of copies that are sorted using the image memory. Thus, copies received by the normal receiving tray 104 are stacked in a simply sorted state.

If a duplex-copy function is selected, a switching claw 113 is set pointed upward, so that the recording sheet with the toner image on one side is conveyed to, before conveyed to the normal receiving tray 104, a duplex-copy feed unit 111. The recording sheet is then temporarily stored in the duplex-copy feed unit 111.

After that, the recording sheet is fed from the duplex-copy feed unit 111 to receive a toner image from the photosensitive element 15. The switching claw 113 is set pointed downward this time, so that the recording sheet with the toner images on both sides is lead to the normal receiving tray 104. In this manner, the duplex-copy feed unit 111 is used to obtain a copy with images on its both sides.

The photosensitive element 15, the convey belt 16, the fixing unit 17, the discharge unit 18, and the developing unit 27 are driven by a main motor (not shown). Each of the feed devices 11 to 13 receives driving of the main motor via a feed clutch (not shown). The vertical convey unit 14 receives driving of the main motor via an intermediate clutch (not shown).

The control system of the image forming apparatus according to the first embodiment is described with reference to FIG. 2. The image forming apparatus includes, as an electrical configuration, an AC plug 201, a relay 209, a power-supply unit 202, a filter 210, a converter 211, an AC drive 212, a heater 213, a mechanism control unit 203, a group of mechanism loads 214, a system control unit 204, an image reading unit 205, an image writing unit 206, a thermoelectric element 207, and a latch 208.

An input side of the AC plug 201 is connected to a commercial power source, and an output side of the AC plug 201 is connected to the relay 209. The relay 209 is used to switch connection between the commercial power source and the image forming apparatus.

An output side of the relay 209 is connected to the power-supply unit 202 that generates the DC voltage from the AC voltage.

Another input side of the relay 209 is connected to the latch 208 to receive a signal that is held by the latch 208 in response to an output of the thermoelectric element 207. Operation of the thermoelectric element 207 is a salient feature in the first embodiment, and will be described in detail later.

The power-supply unit 202 includes the filter 210, the converter 211, and the AC drive 212. When the power-supply unit 202 receives AC voltage, the filter 210 removes AC noise ripple from the AC voltage, and the converter 211 converts the noise-ripple removed AC voltage into DC voltage. That is, the converter 211 generates the DC voltage including 24 voltages and 5 voltages from the AC voltage.

The image forming apparatus includes rollers heated by the heater 213 to fix the toner image on the recording sheet. The AC drive 212 controls ON/OFF of the heater 213.

The DC power generated by the power-supply unit 202 is supplied to the mechanism control unit 203 and the system control unit 204.

The mechanism control unit 203 includes a CPU (not shown) and an I/O control driver (not shown). When receiving the DC power, the CPU activates and performs driving of the mechanism loads 214 according to a predetermined image-forming sequence.

The image reading unit 205 includes a lamp (not shown) that illuminates an original, and a CCD (not shown). The image reading unit 205 reads image data of the original by emitting a light to the original placed on an exposure glass and then receiving the light reflected from the original.

Upon receiving, as synchronizing with operation of the mechanism control unit 203, the image data from the image reading unit 205, the system control unit 204 processes the received image data and sends the processed image data to the image writing unit 206.

Upon receiving the processed image data from the system control unit 204, the image writing unit 206 switches ON/OFF of a laser diode based on the received image data, and emits a laser light from the laser diode to the photosensitive element, thereby forming an electrostatic latent image on a photosensitive element. After that, the electrostatic latent image on the photosensitive element is developed with toners, the developed toner image is transferred onto a recording medium, and the recording medium with the image is obtained.

When the system control unit 204 detects that a long period has been passed since the last operation or a command to shift to the sleep mode has been received from a user using the operation key, the system control unit 204 asserts the AC_OFF signal. In response to the asserted AC_OFF signal, the switches of the power-supply unit 202 turn OFF and the power-supply unit 202 stops supplying the 5-V power and the 24-V power to the mechanism control unit 203. Thus, the image forming apparatus is shifted to the sleep mode.

Figure 4:
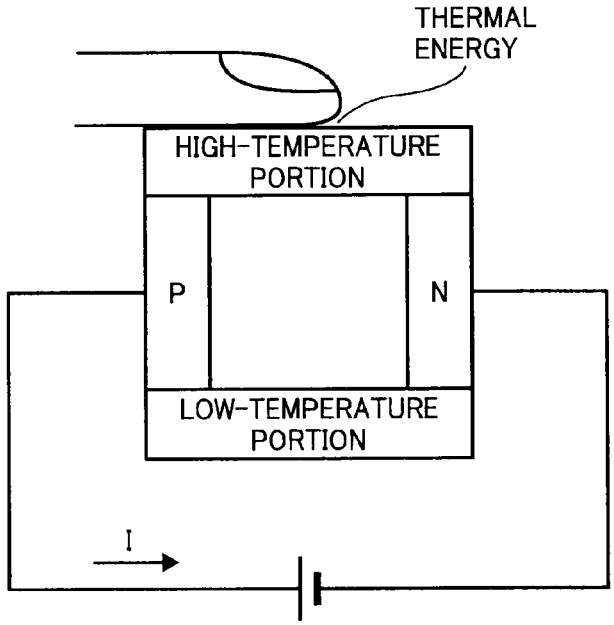
FIG. 4 is a schematic diagram of the thermoelectric element.

The thermoelectric element 207 is described in detail below. FIG. 4 is a schematic diagram of the thermoelectric element 207.

The thermoelectric element 207 generates electric power from heat of a human body. More particularly, the thermoelectric element 207 converts thermal energy of a heating element into electric power by using a so-called Seebeck effect. For example, a pn-type thermoelectric element including a plurality of pn elements arranged in series is used as the thermoelectric element 207. The thermoelectric element 207 generates the electric power by using thermal difference that is caused by a touch of the thermoelectric element 207 by a human body.

As shown in FIG. 3, the thermoelectric elements 207 are arranged on an operation key 301, a knob portion 302 of the platen, and a knob portion 303 of a document-tray cover for the ADF 1.

An output side of the thermoelectric element 207 is connected to the latch 208. An output that is held by the latch 208 is sent to the relay 209.

Figure 2:
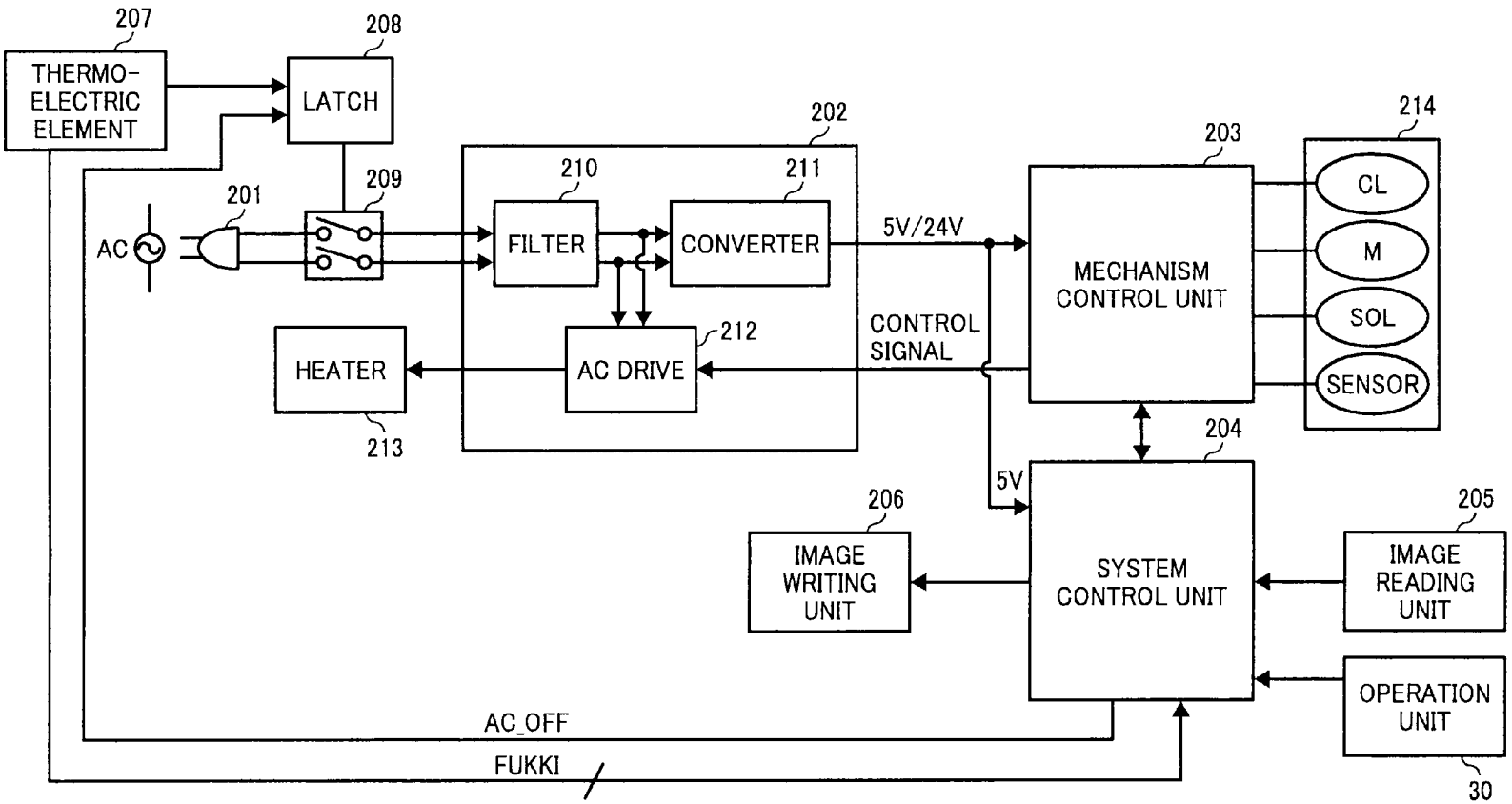
FIG. 2 is a block diagram of a control system of the image forming apparatus shown in FIG. 1.

As shown in FIG. 2, another output side of the thermoelectric element 207 is connected to the system control unit 204. While receiving the power from the thermoelectric element 207, the system control unit 204 can monitor a state of each of the thermoelectric elements 207 with a FUKKI signal. In other words, after activated by one of the thermoelectric elements 207, the system control unit 204 identifies the thermoelectric element 207 that acts as the return factor.

Moreover, the system control unit 204 includes a timer (not shown). When it is determined with the timer that a predetermined period has passed since the last operation, the system control unit 204 asserts the AC_OFF signal. In response to the asserted AC_OFF signal, the latch 208 negates the latch output to switch the relay 209 to OFF. Thus, the AC power supply to the image forming apparatus is cut off.

In this manner, the image forming apparatus automatically performs the operation shifting to the sleep mode when a long period has passed since the last operation. Because the AC power supply is cut off substantially during the sleep mode, the power consumption of the image forming apparatus decreases to nearly zero watt.

When the user touches the thermoelectric element 207 during the sleep mode to operate the image forming apparatus, the thermoelectric element 207 generates the electric power. After that, the latch 208 is turned ON, the output of the latch 208 is asserted, and the relay 209 is turned ON. Thus, the main power is supplied to the image forming apparatus, and the image forming apparatus activates, i.e., is in the power-ON state.

In the conventional image forming apparatus, the system control unit 1007 is required to be in an active state to detect whether the user tries to operate the image forming apparatus. In other words, it is necessary to generate a minimum power for maintaining the active state of the system control unit 1007. Therefore, it is practically impossible to achieve the nearly zero-watt operation during the sleep mode.

On the other hand, in the image forming apparatus according to the first embodiment, the relay is turned ON by using the electromotive force generated by the thermoelectric element. In other words, it is unnecessary to generate power for detecting the operation state during the sleep mode. Therefore, it is possible to achieve the nearly zero-watt operation during the sleep mode.

Figure 5:
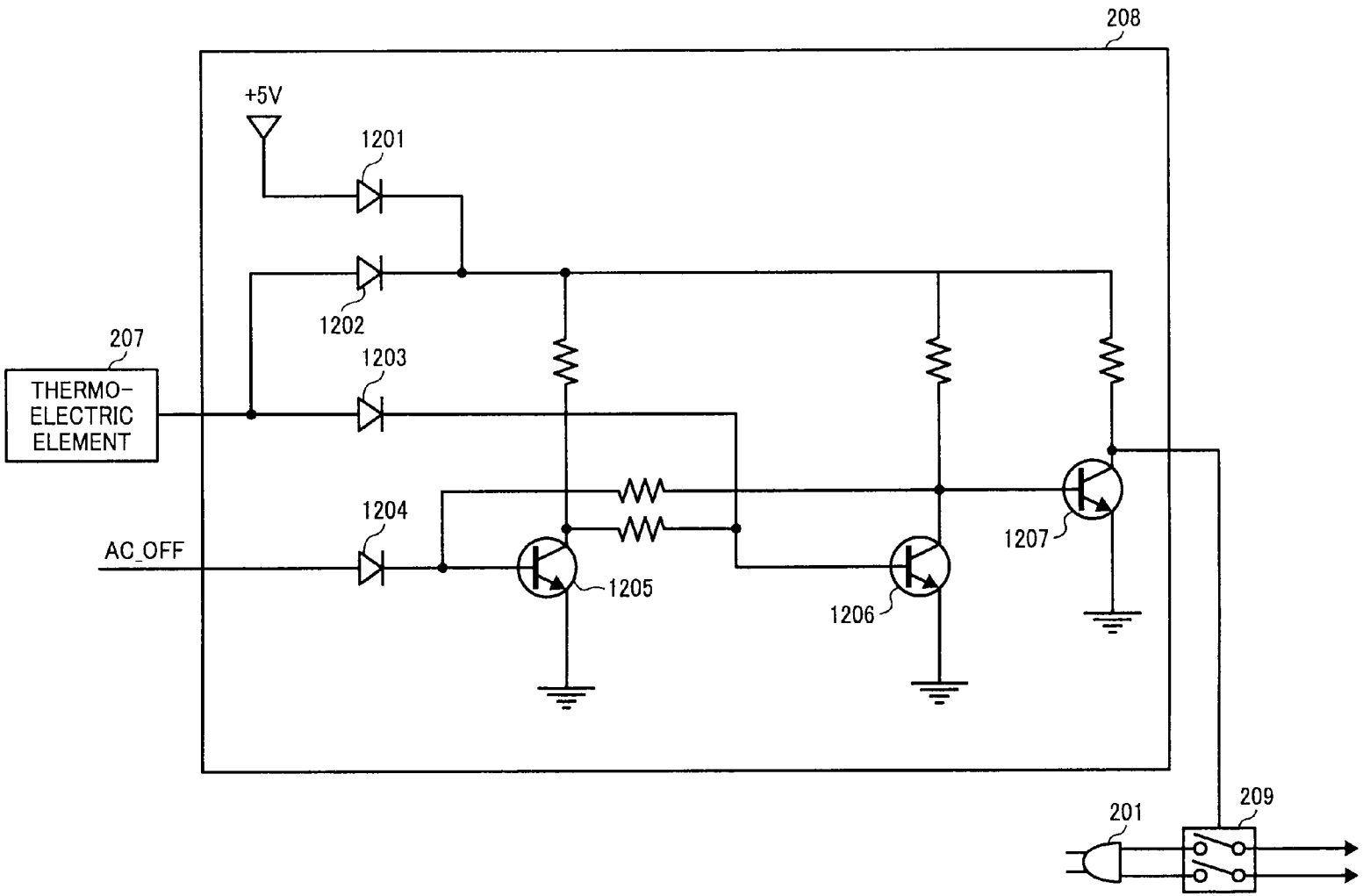
FIG. 5 is an example of a latch shown in FIG. 2.

The operation of the latch 208 is described below with reference to FIG. 5. The latch 208 includes diodes 1201 to 1204, transistors 1205 to 1207, and resistances.

When the user touches the thermoelectric element 207, the electromotive force is generated. The diodes 1202 and 1203 are turned ON by the electromotive force, and thereby the transistor 1206 is turned ON. When the transistor 1206 is ON, collector voltage is "L" level. Thereby, the transistor 1207 is turned OFF, and the relay 209 is turned ON. Finally, the AC power is supplied to the power-supply unit 202. At the same time, a base of the transistor 1206 is "H" level because the transistor 1205 is OFF, so that an ON-state of the transistor 1206 is held. The DC power is generated at this time, so that the generated 5-V DC power is supplied to the transistor 1206 even if the user releases from the thermoelectric element 207. As a result, the ON-state of the transistor 1206 is maintained afterward.

When a long period has passed since the last operation, the system control unit 204 asserts the AC_OFF signal. In response to the asserted AC_OFF signal, the transistor 1205 is turned ON, the collector potential decreases to "L" level, and then the transistor 1206 is turned OFF. When the transistor 1206 is OFF, the collector potential of the transistor 1206 is "H" level and the transistor 1207 is ON. As a result, "L" level is output to the relay 209. Upon receiving "L" level, the relay is turned OFF. Finally, the AC power supply to the power-supply unit 202 is cut off.

In this manner, when the user touches the thermoelectric element 207, the DC power keeps is turned ON and the ON state is maintained afterward. While when a predetermined period has passed since the last operation, the DC power is turned OFF.

Figure 6:
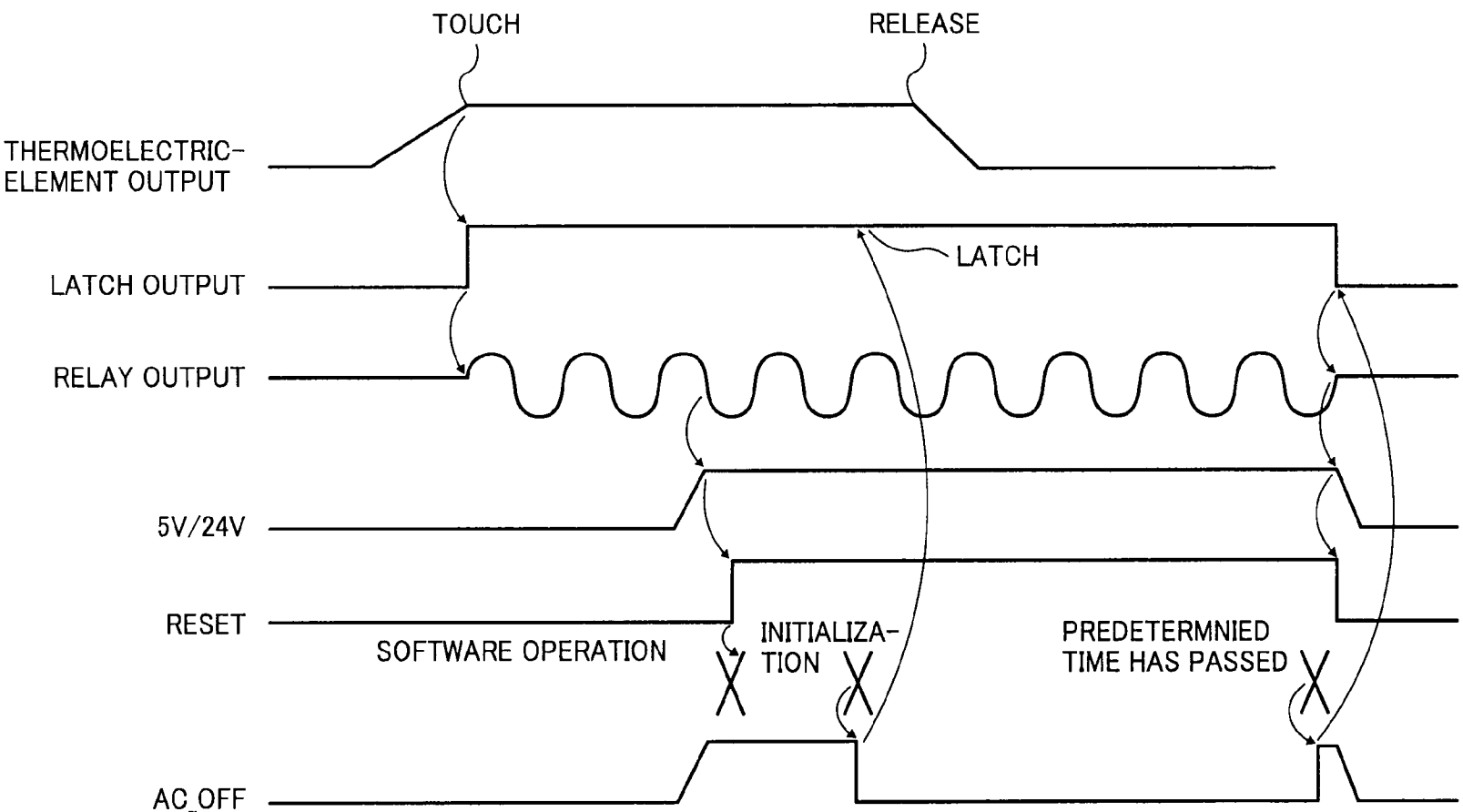
FIG. 6 is a timing chart for explaining a power-ON operation from a sleep mode.

The power-ON operation from the sleep mode is described below with reference to a timing chart shown in FIG. 6.

When the user touches the thermoelectric element 207, the electric power is generated by the thermoelectric element 207, and the generated electric power is latched by the latch 208. In response to the asserted latch single, the relay 209 is turned ON. Thus, the AC power is supplied to the image forming apparatus. After the AC power supplying, the power-supply unit 202 generates the DC voltage including 24 volts and 5 volts.

When receiving the DC voltage, the system control unit 204 and the mechanism control unit 203 are released from a reset state; the CPU starts operation and an initialization process starts. When the initialization process is completed, the system control unit 204 negates the AC_OFF signal. In response to the negated AC_OFF signal, the output of the latch 208 is held, so that the ON-state of the relay 209 is maintained. Another initialization process is performed simultaneously. Other initialization processes are performed, simultaneously. When the other initialization processes are completed, the image forming apparatus is ready to operate.

When the timer of the system control unit 204 is up, i.e., when a predetermined period has passed since the last operation, the AC_OFF signal is asserted. In response to the asserted AC_OFF signal, the output of the latch 208 is negated, and thereby the relay 209 is turned OFF. Thus, the AC power supply is cut off, i.e., the image forming apparatus is in the sleep mode.

The image forming apparatus according to the first embodiment is a multifunction product (MFP) including at least one application function. The image forming apparatus activates, i.e., is in the power-ON state from the power-OFF state including the sleep mode by turning the main-power switching unit ON in response to the output of the thermoelectric element and thereby receiving the main power.

The image forming apparatus includes the thermoelectric element, the main-power switching unit, and the control unit. The thermoelectric element generates electric power by using the Seebeck effect from temperature difference caused by a touch of the thermoelectric element by a human body. The main-power switching unit is used to switch ON/OFF of the main power in response to the output of the thermoelectric element. The control unit controls the control system and the application function using the main power passed through the main-power switching unit. When the user touches the thermoelectric element in a situation that the main power is OFF, the main power supply is switched to ON and then the image forming apparatus activates.

The main power that is switched to ON/OFF by using the main-power switching unit in response to the output of the thermoelectric element is the AC power.

The ON/OFF of the main-power switching unit is corresponding to ON/OFF of the converter that converts the AC power into the DC power.

The thermoelectric element is arranged on the operation panel so that the image forming apparatus can activate when the user touches the operation panel.

Alternatively, the thermoelectric element is arranged on a knob portion of the platen so that the image forming apparatus can activate when the user touches the platen to try to place an original on the exposure glass.

Still alternatively, the thermoelectric element is arranged on so that the image forming apparatus can activate when the user touches the knob portion of the document-tray cover to try to place an original on the ADF.

The image forming apparatus according to the first embodiment includes the control unit that controls at least one application function. The control unit includes the internal timer and a signal generating unit. The signal generating unit generates a first signal in response to which the control unit turns the main power ON and a second signal in response to which the control unit turns the main power OFF. The second signal is generated when a long period has passed since the last operation.

When the latch receives the first signal from the control unit, the output of the thermoelectric element is latched and thereby the ON-state of the AC power is maintained. When the latch receives the second signal from the control unit, the AC power is switched to OFF.

When the latch receives the first signal from the control unit, the output of the thermoelectric element is latched and thereby the ON-state of the converter that generates the DC powers from the AC power is maintained. When the latch receives the second signal from the control unit, the converter is switched to OFF.

According to an aspect of the first embodiment, it is possible to provide a system in which the power consumption automatically decreases to nearly zero if the image forming apparatus is in non-operation, while the image forming apparatus automatically activates when the user accesses to the image forming apparatus.

The image forming apparatus in the first embodiment responds using the thermoelectric element a physical action by the user who tries to operate the image forming apparatus. In contrast, an image forming apparatus including an external-device interface according to a second embodiment of the present invention receives various data via the external-device interface even in the sleep-mode, and automatically switches to the stand-by mode in response to the received data.

Figure 7:
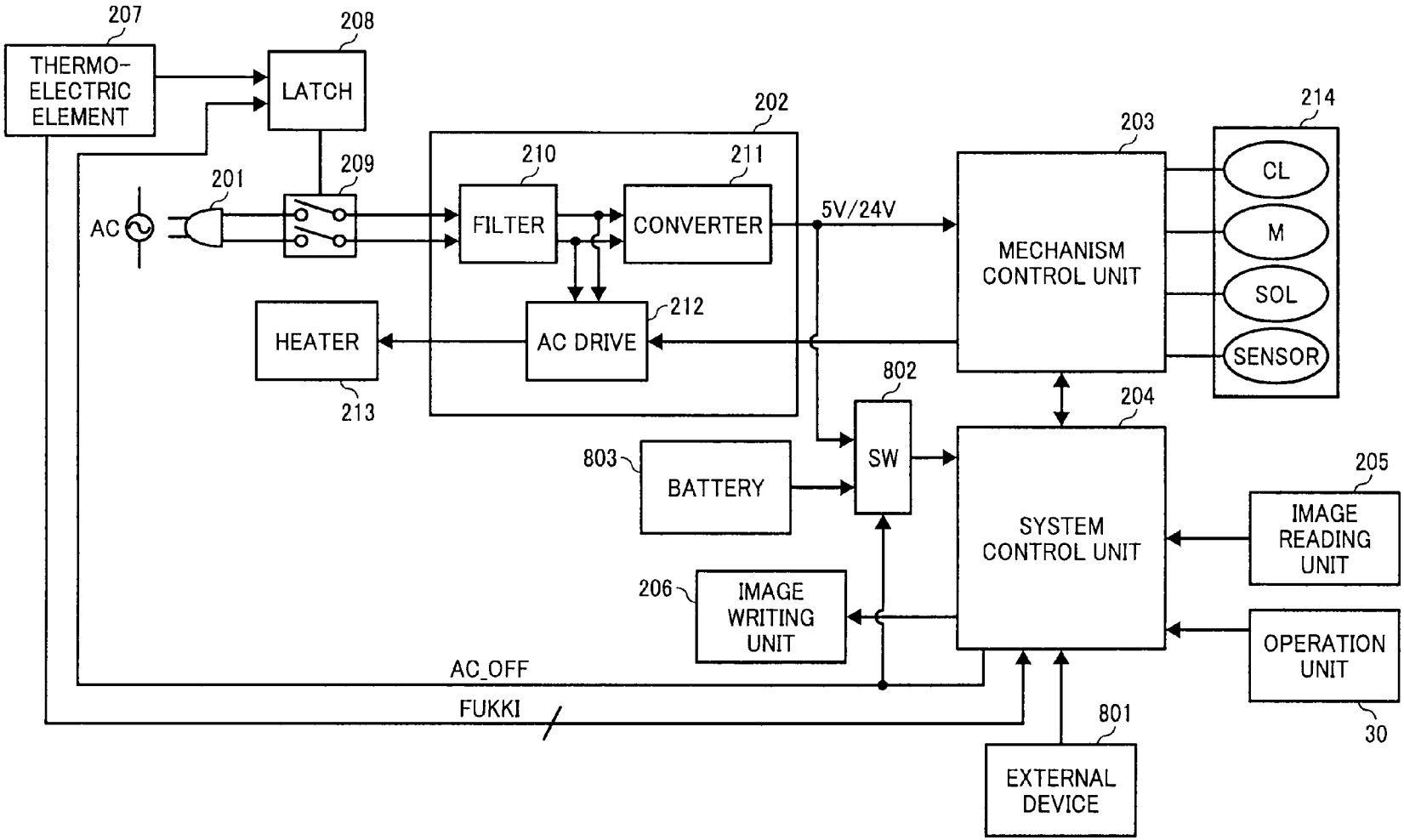
FIG. 7 is a block diagram of a control system of an image forming apparatus according to a second embodiment of the present invention.
Figure 8:
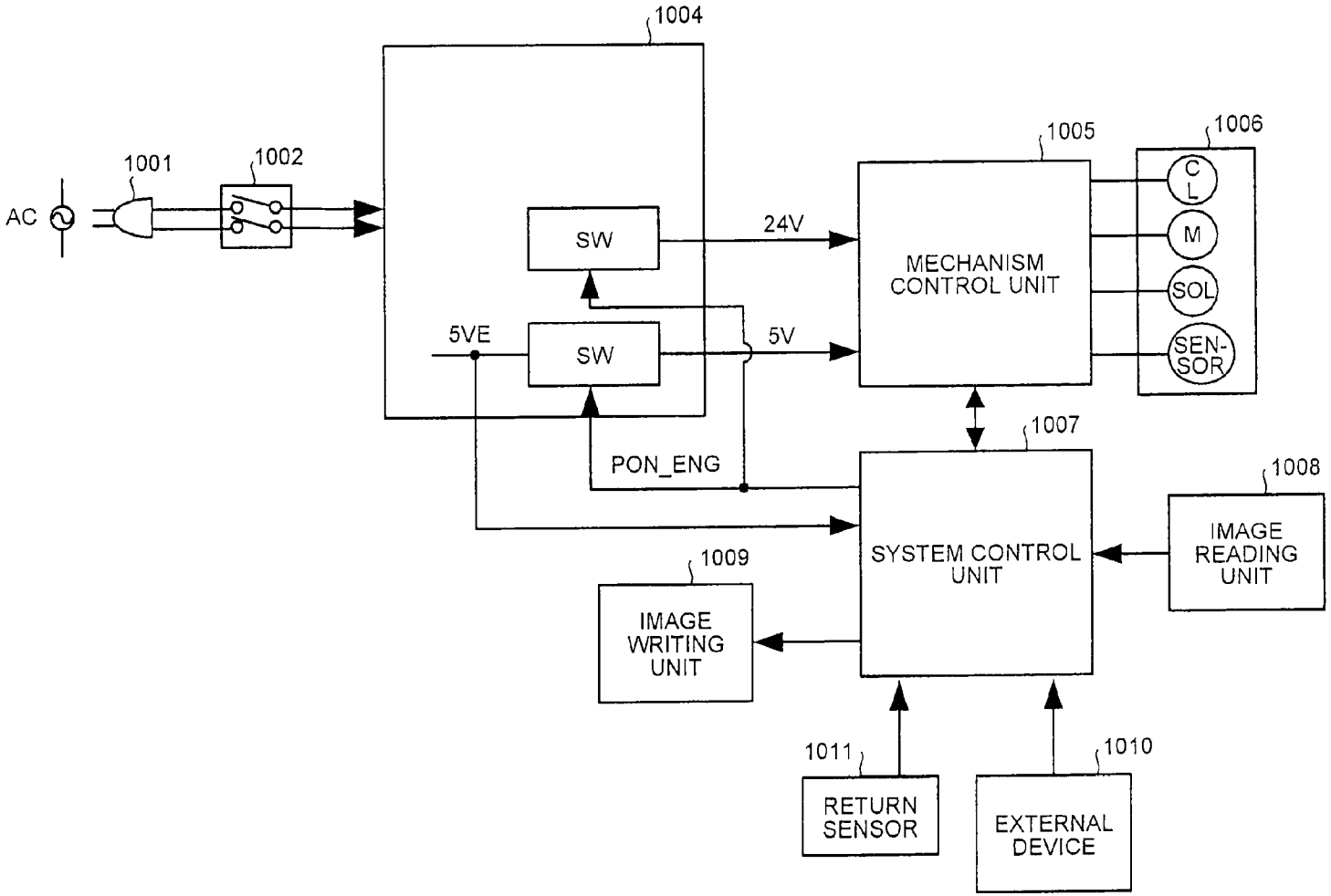
FIG.8 PRIOR ART
FIG. 8 is a block diagram of a control system of a conventional image forming apparatus.
Figure 9:
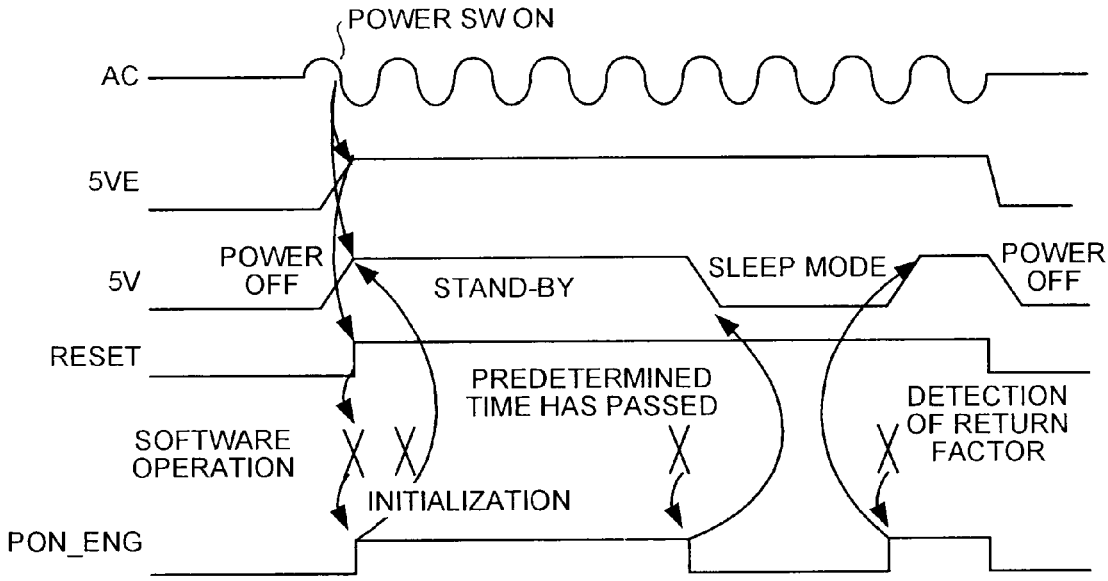
FIG.9 PRIOR ART
FIG. 9 is a timing chart for explaining an operation performed by the conventional image forming apparatus.

As shown in FIG. 7, the image forming apparatus in the second embodiment includes a switch 802, and a battery 803 in addition to those units of the image forming apparatus in the first embodiment. The image forming apparatus is connected to an external device 801 such as a personal computer. The system control unit 204 receives image data created by the external device 801, and processes the received image data by using various processing such as enlarging, reducing, layout change, stamping, or rotating. The system control unit 204 sends the processed image data to the image writing unit 206.

The battery 803 charges power during the main power being supplied to the image forming apparatus, while discharges the charged power when the main power is OFF.

The switch 802 is used to switch connection of the system control unit 204 with either the power-supply unit 202 (5 volts) or the battery 803. When the system control unit 204 asserts the AC_OFF signal, the switch 802 is automatically switched to the battery 803, and thereby the system control unit 204 receives power from the battery 803.

In this manner, the system control unit 204 receives the power from the battery 803 during the sleep mode in which the AC power is cut off by the relay 209. Such a configuration makes it possible to receive an image-data receive request from the external device 801 during the sleep mode.

When receiving the image data from the external device 801, the system control unit 204 negates the AC_OFF signal. In response to the negated the AC_OFF signal, the latch 208 is turned ON and then the relay 209 is turned ON. Thus, the image forming apparatus activates, i.e., the main power is ON.

The image forming apparatus is configured to receive, when the image-data receive request coming from the external device 801 is detected, the AC power by the ON-state of the latch 208 and thereby receive image data and perform image-forming operation based on the received image data. Therefore, it is enough to supply power only to a specific unit of the system control unit 204 that detects the image-data receive request coming from the external device 801 without supplying power to the system control unit 204.

This makes it possible to decrease the consumption current during the sleep mode to the minimum level with and use a battery with lower capacitance as the battery 803.

The image forming apparatus according to the second embodiment includes a unit that charges electric power such as a battery. The battery is used to charge electric power during the stand-by mode, while used to supply the charge to the unit that detects a command to activate the image forming apparatus. With this configuration, the main power turns ON when data is received from the external device.

In this manner, it is possible to decrease the power consumption to nearly zero during the sleep mode by use of the battery while the AC power being OFF.

Although the battery is used in the second embodiment, it is possible to obtain the same effect by using instead of the battery any device that charges electric power for a long period.

The above-described embodiments are exemplary embodiments of the present invention. Therefore, the present invention is not limited to the above-described embodiments, and various modifications can be made to the present invention based on the technical ideas of the present invention.

For example, the thermoelectric element 207 in the first embodiment is arranged on the operation key 301, the knob portion 302 of the platen, or the knob portion 303 of a document-tray cover for the ADF. However, the thermoelectric element can be arranged on any position, including a knob portion of the feed cassette or a portion of the bypass feed tray, at which the user is easy to operate or the user is able to or likely to touch.

Moreover, although the relay is used to cut off the main power in response to the output of the thermoelectric element, it is possible to obtain the same effect by using any device that cuts off the AC power such as a triac, a solid state relay (SSR).

Alternatively, it is possible to obtain the same effect by switching ON/OFF of the converter of the power-supply unit 202 that generates the DC voltage from the AC voltage.

Furthermore, although the power supply system including the thermoelectric element 207, the latch 208, and the relay 209 is used in the image forming apparatus, the power supply system can be used in any other electric appliance that performs a predetermined operation using the power received through the power supply system. There are various electric appliances having such configuration including a cellular phone or a personal digital assistant (PDA) in which, when the power is ON with a press of a switch or the like, texts or images are displayed on the liquid crystal display, a mobile music player in which, when the power is ON with a press of a switch or the like, music is replayed, and various information processing devices such as a personal computer.

Moreover, if the electric appliance such as the image forming apparatus, the cellular phone, or the information processing device includes a sensor such as a touch sensor, it is possible to reduce the power consumption of the electric appliance by stopping the power supply using the sensor instead of the thermoelectric element.

According to an aspect of the present invention, the image forming apparatus can reduce the power consumption during a period starting when a predetermined period has passed since the last operation. Moreover, the image forming apparatus can automatically activate when a user accesses the image forming apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a thermoelectric conversion element that converts thermal energy of a user into first electric power;

a holding unit that holds the first electric power converted by the thermoelectric conversion element, and outputs the first electric power; and a switching unit that switches between a first mode in which second electric power from a main power supply is supplied to a power-supply unit of the image forming apparatus and a second mode in which the second electric power from the main power supply is not supplied to the power-supply unit of the image forming apparatus, wherein when the image forming apparatus is in the second mode, the switching unit switches from the second mode to the first mode upon receiving the first electric power output from the holding unit.

2. The image forming apparatus according to claim 1, further comprising:

a control unit that controls the switching unit to switch from the first mode to the second mode in a predetermined time.

3. The image forming apparatus according to claim 2, further comprising:

a command receiving unit that receives a first command to set the image forming apparatus to the second mode, wherein upon receiving the first command from the command receiving unit, the control unit further controls the switching unit to switch from the first mode to the second mode.

4. The image forming apparatus according to claim 3, wherein the main power supply is an alternating-current source that outputs alternating current, and the power-supply unit includes a converter that converts the alternating current from the alternating-current source into direct current, wherein the control unit activates all units or a part of units of the image forming apparatus by receiving the direct-current from the converter, and upon receiving the first command from the command receiving unit, informs the first command to the switching unit, and the switching unit activates the converter upon receiving the electric power output from the holding unit, or stops the converter following the first command informed from the control unit.

5. The image forming apparatus according to claim 2, further comprising:

a timer that measures elapsed time since the image forming apparatus is activated, wherein when the elapsed time reaches a predetermined time, the control unit controls the switching unit to switch from the first mode to the second mode by generating a signal to set the image forming apparatus to the second mode.

6. The image forming apparatus according to claim 4, wherein the control unit sends an instruction to switch ON and OFF the alternating-current source to the switching unit, and the switching unit switches ON and OFF the alternating-current source following the instruction from the control unit.

7. The image forming apparatus according to claim 4, wherein the control unit sends an instruction whether to supply the alternating current to the converter to the switching unit, and the switching unit supplies and stops supplying the alternating current to the converter following the instruction from the control unit.

8. The image forming apparatus according to claim 2, further comprising:

a battery unit that charges therein electric power; and a data receiving unit that receives image data from an external device, wherein when the image forming apparatus is in the second mode, the control unit detects whether the data receiving unit receives the image data, and when it is detected that the data receiving unit received the image data, controls the holding unit to output the first electric power to the switching unit to switch from the second mode to the first mode.

9. The image forming apparatus according to claim 1, wherein the thermoelectric conversion element is arranged on an operation panel.

10. The image forming apparatus according to claim 1, wherein the thermoelectric conversion element is arranged on a knob portion of a platen.

11. The image forming apparatus according to claim 1, wherein the thermoelectric conversion element is arranged on a knob portion of a document-tray cover of an automatic document feeder.

12. The image forming apparatus according to claim 1, wherein the main power supply is an AC power supply and the backup power supply.

13. The image forming apparatus according to claim 1, wherein the power-supply unit converts the second electric power from the main power supply into direct current to activate each unit of the image forming apparatus.

14. An electric appliance comprising:

a thermoelectric conversion element that converts thermal energy of a user into first electric power;

a holding unit that holds the first electric power converted by the thermoelectric conversion element, and outputs the first electric power; and a switching unit that switches between a first mode in which second electric power from a main power supply is supplied to a power-supply unit of the electric appliance and a second mode in which the second electric power from the main power supply is not supplied to the power-supply unit of the electric appliance, wherein when the electric appliance is in the second mode, the switching unit switches from the second mode to the first mode upon receiving the first electric power output from the holding unit.

15. The electric appliance of claim 14, wherein the main power supply is an AC power supply.

16. The electric appliance according to claim 14, wherein the power-supply unit converts the second electric power from the main power supply into direct current to activate each unit of the appliance.

* * * * *